US009574740B2

(12) United States Patent
Lanoye et al.

(10) Patent No.: US 9,574,740 B2
(45) Date of Patent: Feb. 21, 2017

(54) DEVICE COMPRISING LIGHT SOURCE AND LIGHT BLOCKER

(71) Applicant: KONINKLIJKE PHILIPS N.V., Eindhoven (NL)

(72) Inventors: Lieve Lea Andrea Lanoye, Eindhoven (NL); Filip Marcel Denise Bruyneel, Eindhoven (NL); Benoit Didier Raphael Catteau, Eindhoven (NL); Etienne Edmond Marie Van Durme, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 331 days.

(21) Appl. No.: 14/353,123

(22) PCT Filed: Oct. 22, 2012

(86) PCT No.: PCT/IB2012/055798

§ 371 (c)(1),
(2) Date: Apr. 21, 2014

(87) PCT Pub. No.: WO2013/061238

PCT Pub. Date: May 2, 2013

(65) Prior Publication Data

US 2014/0268760 A1 Sep. 18, 2014

Related U.S. Application Data

(60) Provisional application No. 61/550,954, filed on Oct. 25, 2011.

(51) Int. Cl.
*F21V 7/00* (2006.01)
*F21V 5/02* (2006.01)
(Continued)

(52) U.S. Cl.
CPC . *F21V 7/00* (2013.01); *F21K 9/60* (2016.08); *F21V 5/02* (2013.01); *F21V 7/0091* (2013.01); *F21V 7/048* (2013.01); *F21Y 2101/00* (2013.01)

(58) Field of Classification Search
CPC ..... F21V 7/00; F21V 5/02; F21V 7/0091; F21V 7/0048; F21K 9/50; F21Y 2101/02
(Continued)

(56) References Cited

U.S. PATENT DOCUMENTS 5,349,504 A 9/1994 Simms
2009/0016070 A1* 1/2009 Montagne ..... F21V 5/04 362/335
2010/0265720 A1 10/2010 Zhang

FOREIGN PATENT DOCUMENTS

DE 102009048032 A1 4/2011
WO WO2005073619 A1 8/2005

* cited by examiner

*Primary Examiner* — Laura Tso
(74) *Attorney, Agent, or Firm* — Larry Liberchuk

(57) ABSTRACT

Devices (100) comprise light sources (1) for producing light into directional ranges (70) and light blockers (10) for blocking the light in parts (71) of the directional ranges (70). The light blockers (10) have inner sides (11) and outer sides (12), and are made of materials having optical indices. Combinations of shapes of the outer sides (12) and the optical indices will reflect the light in the parts (71) of the directional ranges (70) at the outer sides (12), for example back to the light sources (1). The shapes of the outer sides (12) may be saw tooth shapes, the optical indices may be larger than 1.4, total reflection may take place for the light in the parts (71) of the directional ranges (70) when incoming at angles smaller than 40° with sides (14, 15) of saw teeth (13) of the saw tooth shapes. Shapes of the inner sides (11) may correspond with shapes of light output graphs of
(Continued)

the light sources (1) in the parts (71) of the directional ranges (70).

11 Claims, 3 Drawing Sheets

(51) Int. Cl.
*F21V 7/04* (2006.01)
*F21Y 101/00* (2016.01)
(58) Field of Classification Search
USPC ..... 362/248
See application file for complete search history.

DEVICE COMPRISING LIGHT SOURCE AND LIGHT BLOCKER

FIELD OF THE INVENTION

The invention relates to a device comprising a first light source for producing first light into a first directional range and a first light blocker for blocking the first light in a part of the first directional range. Examples of such a device are video devices and lighting devices.

BACKGROUND OF THE INVENTION

Devices comprising light sources and light blockers are of common general knowledge.

A video device such as a television receiver usually comprises a display for displaying video, and may further comprise a light source for producing ambient light for supporting the video. To direct the ambient light into preferred directions, a light blocker may be used to block the ambient light in non-preferred directions.

A lighting device such as a lamp usually comprises a light source for producing light. To direct the light into preferred directions, a light blocker may be used to block the light in non-preferred directions.

Known light blockers for example absorb the light, which reduces an efficiency of the light source of the device.

SUMMARY OF THE INVENTION

It is an object of the invention to provide an improved device. Such an improved device for example comprises an improved light blocker.

According to an aspect of the invention, a device is provided comprising a first light source for producing first light into a first directional range, and a first light blocker for blocking the first light in a part of the first directional range, the first light blocker having an inner side and an outer side, the inner side being located more closely to the first light source than the outer side, and first light blocker being made of a material having an optical index, a combination of a shape of the outer side and the optical index being arranged to reflect the first light in the part of the first directional range at the outer side.

The device comprises a first light source for producing first light into a first directional range, such as 180° or 270° or 360° or any other range. The device further comprises a first light blocker for blocking the first light in a part of the first directional range, such as 22.5° or 45° or 67.5° or 90° or any other part of said range. The range may be a two-dimensional range in a two-dimensional environment and may be a three-dimensional range in a three-dimensional environment.

The first light blocker has an inner side and an outer side. The inner side is located more closely to the first light source than the outer side. The first light blocker is made of a material having an optical index. A combination of a shape of the outer side and the optical index is arranged to reflect the first light in the part of the first directional range at the outer side. As a result, an improved first light blocker has been created. In such an improved first light blocker, the first light is reflected and can be used outside the part of the first directional range. A device comprising such an improved light blocker has an improved efficiency compared to devices using light blockers that mainly absorb the light. As a result, an improved device has been created.

An embodiment of the device is defined by the combination of the shape of the outer side and the optical index being arranged to reflect the first light in the part of the first directional range at the outer side in a direction of the first light source. When reflecting the first light back to the first light source, the reflected first light will arrive at a first side of the first light source and then pass the first light source under a condition that the first light source is sufficiently transparent and/or sufficiently small and then leave at a second side of the first light source. This way, at the second side of the first light source, the reflected first light supports original first light coming from the first light source.

An embodiment of the device is defined by the shape of the outer side being a saw tooth shape, the optical index being larger than 1.4 and total reflection taking place for the first light in the part of the first directional range when incoming at an angle smaller than 40° with a first side or a second side of a saw tooth of the saw tooth shape. Preferably, the optical index is larger than 1.5 and total reflection takes place for the first light when incoming at an angle smaller than 50° with one of both sides of the saw tooth.

An embodiment of the device is defined by each saw tooth of the saw tooth shape having a third side relatively perpendicular to a line going through a center of the first light source and a top of the saw tooth. Preferably, this line cuts the saw tooth into two identical halves.

An embodiment of the device is defined by a shape of the inner side corresponding with a shape of a light output graph of the first light source in the part of the first directional range. This way, the device is further optimized. The light output graph of the first light source is for example a collection of points where the light output has a same predefined intensity or a same predefined amplitude.

An embodiment of the device is defined by a distance between the light output graph of the first light source in the part of the first directional range and the inner side being relatively constant for the entire part of the first directional range. This way, a correspondence between the shape of the inner side and the shape of the light output graph is easily created.

An embodiment of the device is defined by the first light source being mounted on a printed circuit board, and the light output graph of the first light source including reflections from the printed circuit board. For a first light source having a relatively omni-directional radiation pattern, when being mounted on a printed circuit board, the first directional range will be about 180° in a two-dimensional plane perpendicular to a plane of the printed circuit board, while using a two-dimensional environment. When using another two-dimensional environment, the first directional range will be about 360° in a two-dimensional plane parallel to a plane of the printed circuit board, but in this case the reflections from the printed circuit board will not contribute. The same principle described above and below can however also be used in a three-dimensional environment.

An embodiment of the device is defined by further comprising a second light source for producing second light into a second directional range, and a second light blocker for blocking the second light in a part of the second directional range, the second light blocker having an inner side and an outer side, the inner side being located more closely to the second light source than the outer side, and second light blocker being made of a material having an optical index, a combination of a shape of the outer side and the optical index being arranged to reflect the second light in the part of the second directional range at the outer side.

An embodiment of the device is defined by the first and second directional ranges being relatively similar ranges, and the parts of the first and second directional ranges being relatively different parts. This way, the first and second light is at least partly directed to different locations.

An embodiment of the device is defined by further comprising respective third and fourth light sources for producing respective third and fourth light, and further comprising respective third and fourth light blockers for blocking the respective third and fourth light, the respective third and fourth light blockers corresponding with the respective first and second light blockers. This way, impair and pair light is at least partly directed to different locations. Preferably, the impair and pair light sources are aligned.

An embodiment of the device is defined by further comprising a display for displaying video, the first and second and third and fourth light forming part of ambient light to be projected on a wall or a ceiling or an object near the device in a moveable way for supporting the video. Especially in case light is to be projected in a moveable way, without using mechanically moveable light blockers, it is of the utmost importance to separate the impair and pair light well from each other, without creating relatively large overlaps or relatively large canyons. The improved light blockers allow such separations.

An embodiment of the device is defined by the first light source comprising a light emitting diode and the first light blocker comprising one or more prisms.

An insight could be that an absorption of light reduces a light efficiency. A basic idea could be that a reflection of light allows the light after being reflected to be used at another location.

A problem to provide an improved device has been solved. An advantage could be that the device will have an improved efficiency.

These and other aspects of the invention will be apparent from and elucidated with reference to the embodiments described hereinafter.

DETAILED DESCRIPTION OF EMBODIMENTS

Figure 1:
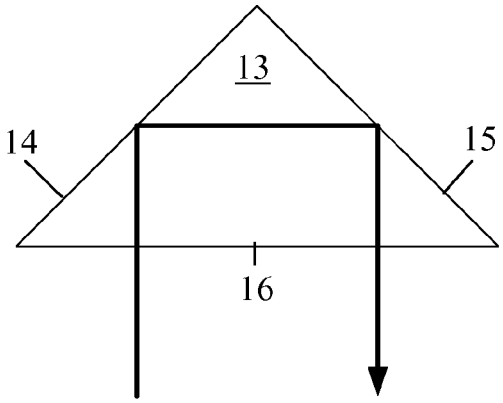
FIG. 1 shows a saw tooth.

In the FIG. 1, a saw tooth 13 is shown, with first and second sides 14 and 15 that form a top of the saw tooth 13 for example at about 90° and with a third side 16 that is relatively perpendicular to a line (not shown here) going through a center of a light source (not shown here) and the top of the saw tooth 13.

Figure 2:
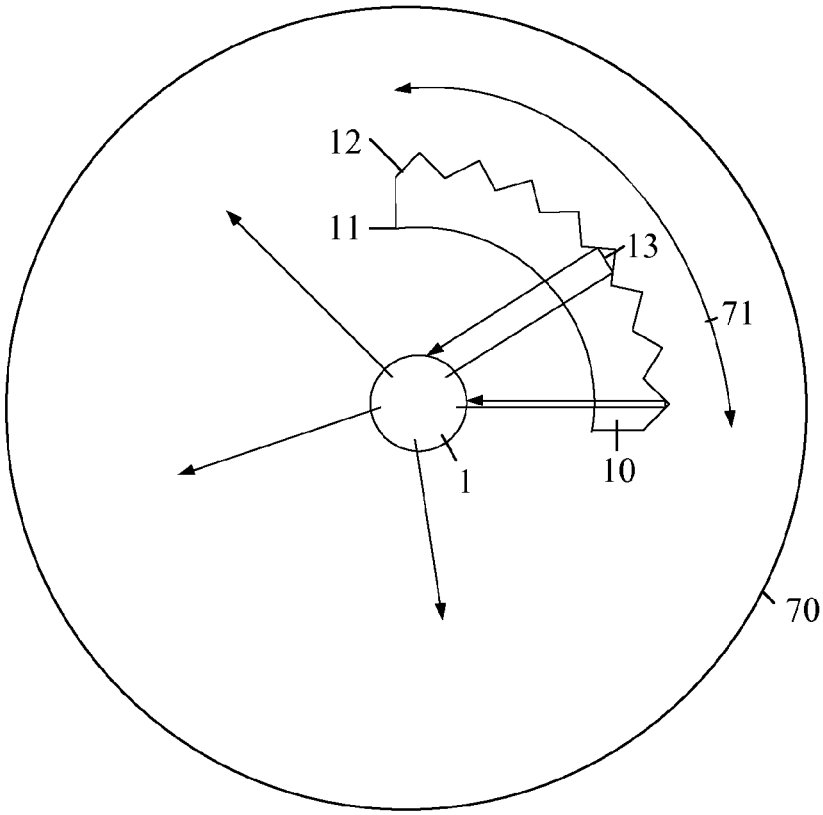
FIG. 2 shows a light source and a light blocker.

In the FIG. 2, a first light source 1 and a first light blocker 10 are shown. The first light source 1 produces first light into a first directional range 70 (here 360°). The first light blocker 10 blocks the first light in a part 71 (here 90°) of the first directional range 70. The first light blocker 10 has an inner side 11 and an outer side 12. The inner side 11 is located more closely to the first light source 1 than the outer side 12. The first light blocker 10 is made of a material having an optical index. A combination of a shape of the outer side 12 and the optical index is arranged to reflect the first light in the part 71 of the first directional range 70 at the outer side 12, preferably, in a direction of the first light source 1.

The shape of the outer side 12 may for example be a saw tooth shape. The optical index may for example be larger than 1.4 and total reflection may for example take place for the first light in the part 71 of the first directional range 70 when incoming at an angle smaller than 40° with the first side 14 or the second side 15 of the saw tooth 13 of the saw tooth shape as indicated in the FIG. 1. Each saw tooth 13 of the saw tooth shape may have a third side 16 relatively perpendicular to a line (not shown here) going through a center of the first light source 1 and the top of the saw tooth 13.

The shape of the inner side 11 may for example correspond with a shape of a light output graph of the first light source 1 in the part 71 of the first directional range 70. Thereto, a distance between the light output graph of the first light source 1 in the part 71 of the first directional range 70 and the inner side 11 may for example be relatively constant for the entire part 71 of the first directional range 70. The light output graph of the first light source 1 is for example a collection of points where the light output has a same predefined intensity or a same predefined amplitude.

In the FIGS. 1 and 2, certain parts of the first light are indicated by the straight arrows.

Figure 3:
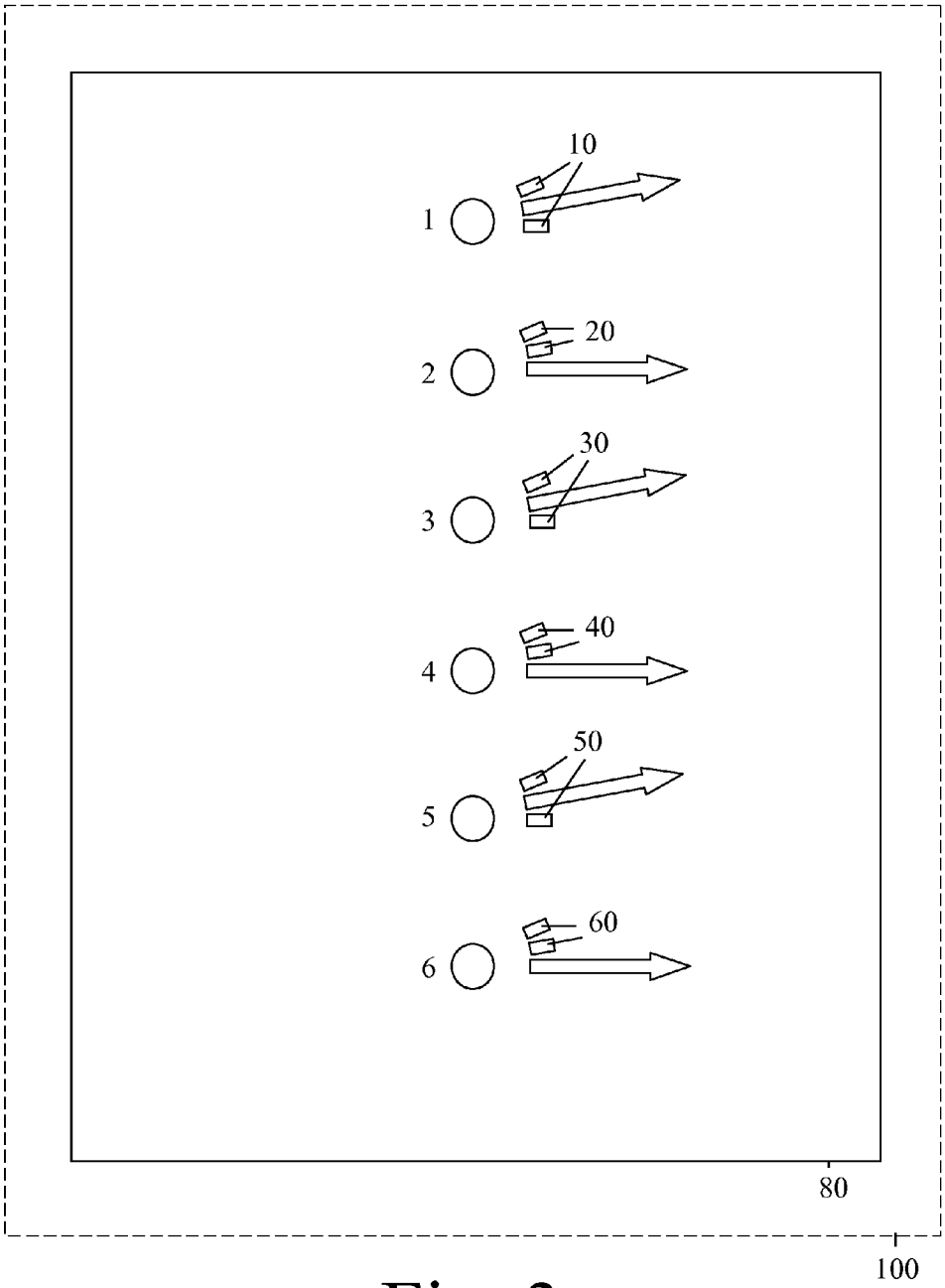
FIG. 3 shows a first embodiment of a device.

In the FIG. 3, a first embodiment of a device 100 is shown. This device 100 comprises a printed circuit board 80 (shown in top view) with six light sources 1, 2, 3, 4, 5 and 6 and with six pairs of light blockers 10, 20, 30, 40, 50 and 60. Here the light blockers 10, 20, 30, 40, 50 and 60 operate such that the light from the light sources 1, 2, 3, 4, 5 and 6 in a plane parallel to a plane of the printed circuit board 80 is blocked. Two neighboring light blockers 20, 40 and 60 for blocking light from the same light source 2, 4 and 6 may of course be combined into a larger one. In the FIG. 3, the directions in which the light can pass and is blocked form part of a relatively small sector for the sake of clarity. To realize this, more and/or larger light blockers may be introduced. Alternatively, the light outside this sector is irrelevant for a certain reason, such as for example in case the light outside the sector cannot leave the device 100 anyway and only the light inside the sector can leave the device 100. Also for the sake of clarity, the light blockers 10, 20, 30, 40, 50 and 60 are drawn in the form of rectangular blocks, where according to a more realistic example they may be in the form as shown in the FIG. 2.

Figure 4:
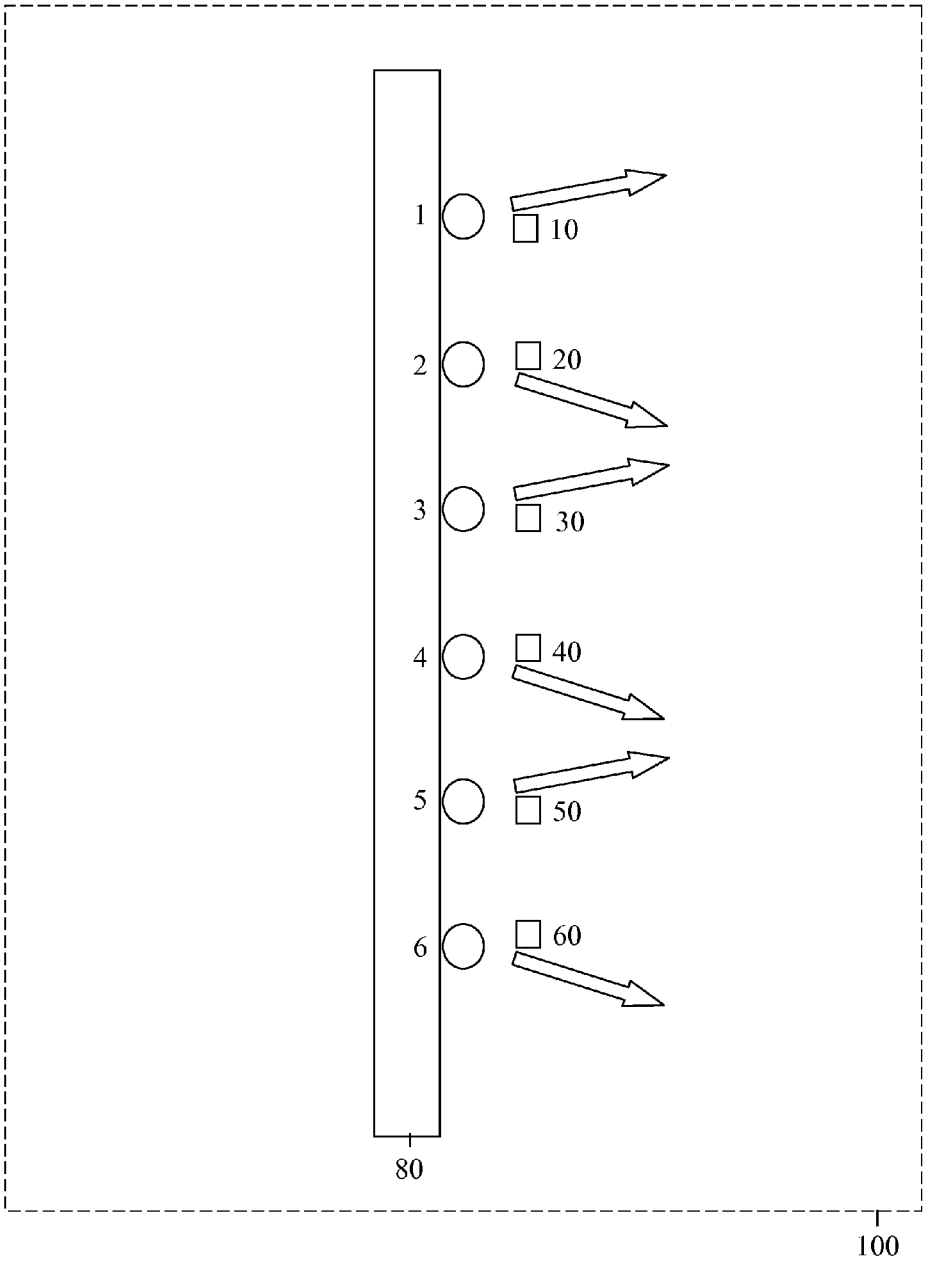
FIG. 4 shows a second embodiment of a device.

In the FIG. 4, a second embodiment of a device 100 is shown. This device 100 comprises a printed circuit board 80 (shown in side view) with six light sources 1, 2, 3, 4, 5 and 6 and with six light blockers 10, 20, 30, 40, 50 and 60. Here the light blockers 10, 20, 30, 40, 50 and 60 operate such that the light from the light sources 1, 2, 3, 4, 5 and 6 in a plane perpendicular to a plane of the printed circuit board 80 is blocked. In the FIG. 4, the directions in which the light can pass and is blocked form part of a relatively small sector for the sake of clarity. To realize this, more and/or larger light blockers may be introduced. Alternatively, the light outside this sector is irrelevant for a certain reason, such as for example in case the light outside the sector cannot leave the device 100 anyway and only the light inside the sector can leave the device 100. Also for the sake of clarity, the light blockers 10, 20, 30, 40, 50 and 60 are drawn in the form of rectangular blocks, where according to a more realistic example they may be in the form as shown in the FIG. 2.

When being mounted on the printed circuit board 80 as shown in the FIG. 4, the light output of the first light source 1 may include reflections from the printed circuit board 80.

In the FIGS. 3 and 4, for the first and second light sources 1 and 2, their first and second directional ranges may be relatively similar ranges, and for the first and second light blockers 10 and 20, their parts of the first and second directional ranges may be relatively different parts. Preferably, pair light resulting from combinations of pair light sources and pair light blockers will go into one or more different directions than impair light resulting from combinations of impair light sources and impair light blockers.

For example in case of the device 100 being a display device comprising a display for displaying video, the light resulting from the combinations of the light sources 1, 2, 3, 4, 5 and 6 and the light blockers 10, 20, 30, 40, 50 and 60 may form part of ambient light to be projected on a wall or a ceiling or an object near the device 100 in a moveable way for supporting the video.

The light sources 1, 2, 3, 4, 5 and 6 may each comprise one or more light emitting diodes and the light blockers 10, 20, 30, 40, 50 and 60 may each comprise one or more prisms.

The FIGS. 3 and 4 show two different two-dimensional environments, but the same principle described above can also be used in a three-dimensional environment.

Above, all ranges, parts of ranges and angles have got exemplary values. Other values are not to be excluded.

Summarizing, devices 100 comprise light sources 1 for producing light into directional ranges 70 and light blockers 10 for blocking the light in parts 71 of the directional ranges 70. The light blockers 10 have inner sides 11 and outer sides 12, and are made of materials having optical indices. Combinations of shapes of the outer sides 12 and the optical indices will reflect the light in the parts 71 of the directional ranges 70 at the outer sides 12, for example back to the light sources 1. The shapes of the outer sides 12 may be saw tooth shapes, the optical indices may be larger than 1.4, total reflection may take place for the light in the parts 71 of the directional ranges 70 when incoming at angles smaller than 40° with sides 14, 15 of saw teeth 13 of the saw tooth shapes. Shapes of the inner sides 11 may correspond with shapes of light output graphs of the light sources 1 in the parts 71 of the directional ranges 70.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A device, comprising a first light source for producing first light into a first directional range; and a first light blocker arranged at a certain distance from the first light source for blocking the first light in a part of the first directional range, the first light blocker having an inner side and an outer side, the inner side being located more closely to the first light source than the outer side, and the first light blocker being made of a material having an optical index, a combination of a shape of the outer side and the optical index being arranged to reflect the first light in the part of the first directional range at the outer side.

2. The device as defined in claim 1, wherein the combination of the shape of the outer side and the optical index is arranged to reflect the first light in the part of the first directional range at the outer side in a direction of the first light source.

3. The device as defined in claim 2, wherein the shape of the outer side is a saw tooth shape, the optical index being larger than 1.4 and total reflection taking place for the first light in the part of the first directional range when incoming at an angle smaller than 40° with a first side or a second side of a saw tooth of the saw tooth shape.

4. The device as defined in claim 3, wherein each saw tooth of the saw tooth shape has a third side relatively perpendicular to a line going through a center of the first light source and a top of the saw tooth.

5. The device as defined in claim 1, wherein a shape of the inner side corresponds with a shape of a light output graph emanating from the first light source in the first directional range.

6. The device as defined in claim 5, wherein a distance between the light output graph of the first light source in the part of the first directional range and the inner side is relatively constant for an entire part of the first directional range.

7. The device as defined in claim 5, wherein the first light source is mounted on a printed circuit board, and the light output graph emanating from the first light source includes reflections from the printed circuit board.

8. The device as defined in claim 1, further comprising a second light source for producing second light into a second directional range, and a second light blocker for blocking the second light in a part of the second directional range, the second light blocker having an inner side and an outer side, the inner side being located more closely to the second light source than the outer side, and second light blocker being made of a material having an optical index, a combination of a shape of the outer side and the optical index being arranged to reflect the second light in the part of the second directional range at the outer side.

9. The device as defined in claim 8, wherein the first and second directional ranges are relatively similar ranges, and the parts of the first and second directional ranges are relatively different parts.

10. The device as defined in claim 9, further comprising respective third and fourth light sources for producing respective third and fourth light, and further comprising respective third and fourth light blockers for blocking the respective third and fourth light, the respective third and fourth light blockers corresponding with the respective first and second light blockers.

11. The device as defined in claim 1, the first light source comprising a light emitting diode and the first light blocker comprising one or more prisms.

* * * * *